US008215733B2

(12) United States Patent
Poncelet et al.

(10) Patent No.: US 8,215,733 B2
(45) Date of Patent: Jul. 10, 2012

(54) PROCESS AND DEVICE FOR INK QUALITY CONTROL

(75) Inventors: Olivier J. Poncelet, Grenoble (FR); Philippe Strauel, Givry (FR)

(73) Assignee: Eastman Kodak Company, Rochester, NY (US)

( * ) Notice: Subject to any disclaimer, the term of this patent is extended or adjusted under 35 U.S.C. 154(b) by 413 days.

(21) Appl. No.: 12/522,305

(22) PCT Filed: Dec. 22, 2007

(86) PCT No.: PCT/EP2007/011411
§ 371 (c)(1),
(2), (4) Date: Jul. 7, 2009

(87) PCT Pub. No.: WO2008/083837
PCT Pub. Date: Jul. 17, 2008

(65) Prior Publication Data

US 2010/0045713 A1 Feb. 25, 2010

(30) Foreign Application Priority Data

Jan. 10, 2007 (FR) ..... 07 00142

(51) Int. Cl.
*B41J 29/38* (2006.01)
*B41J 2/195* (2006.01)

(52) U.S. Cl. ..... 347/6; 347/7

(58) Field of Classification Search ..... 347/6–7
See application file for complete search history.

(56) References Cited

U.S. PATENT DOCUMENTS 6,155,664 A * 12/2000 Cook ..... 347/7
6,312,118 B1 11/2001 Lerat et al.
2004/0157209 A1 8/2004 Yilmaz et al.

FOREIGN PATENT DOCUMENTS

WO WO0058709 A * 3/2000

* cited by examiner

*Primary Examiner* — Jason Uhlenhake
(74) *Attorney, Agent, or Firm* — William R. Zimmerli

(57) ABSTRACT

An apparatus and process of controlling ink quality are provided. The process includes providing an imprinted polymer microbalance in an inkjet printer, whereby the microbalance presents an equilibrium setpoint vibratory characteristic when in contact with a setpoint ink containing at least one target compound compatible with the imprinted polymers; placing the microbalance in contact with a supply ink printer; measuring a vibratory characteristic of the microbalance; and issuing a warning when the vibratory characteristic is different from the setpoint characteristic.

10 Claims, 1 Drawing Sheet

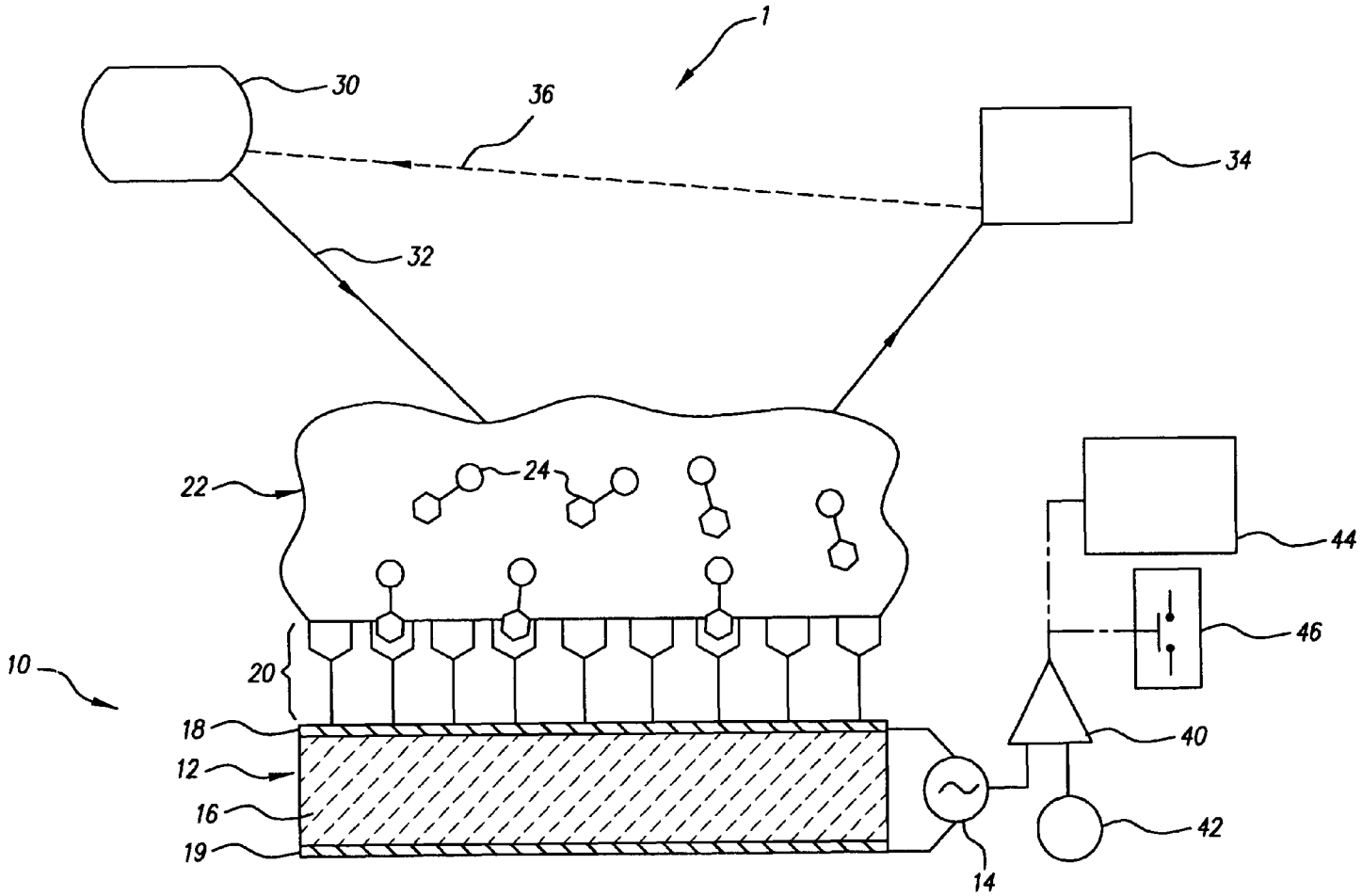
1
30
36
32
34
22
24
44
46
40
42
14
20
18
12
16
19
10

PROCESS AND DEVICE FOR INK QUALITY CONTROL

FIELD OF THE INVENTION

The present invention relates to an ink control process and method.

The invention has applications in the control and monitoring of the quality of ink supplied to or used in a printer, in particular the control of the quality of liquid inks used in inkjet printers. Although industrial and professional applications for the invention are in no way excluded, the invention targets the control of ink quality in home printers.

BACKGROUND OF THE INVENTION

Printers, and in particular inkjet printers, are in fact vulnerable to the quality of the inks used. If inappropriate or modified inks are used, the end result is at best poor color rendering or poor print density. Inappropriate or modified inks can also clog the inkjet nozzles and destroy the print head.

In general, an ink that does not present color and viscosity properties geared to the printer used will have a negative impact on the quality of the print proofs. However, inexperienced users are not necessarily able to identify the underlying cause of the resulting poor print quality. The risk is that they will wrongly lay the blame on the quality of the printer or the print media.

To prevent these ink supply problems, printers can be fitted with foolproofing devices making it impossible to fit non-compatible ink reservoirs or cartridges. However, this measure often proves inadequate.

The difficulties involved in ink control are made more difficult still with cartridge-based printers designed for home use. There is a very large market for compatible cartridges, but the inks on offer do not present exactly the same properties as those of the inks specially designed for use with a particular printer. In certain cases, the market also offers cartridge refills and refill kits enabling users to refill spent cartridges. Once again, the refill inks are not always of the highest quality.

Finally, the ink cartridge market also falls prey to counterfeit goods and illicit copies, where cartridges touted as being dedicated to the printer in fact contain inks of a vastly lower quality than that legitimately expected by the user.

SUMMARY OF THE INVENTION

It is an object of the invention to propose and a process and a device designed to warn the user of the fact that an ink they are about to use may have a negative impact on the print quality performance of their printer, possibly even damaging the printer itself.

Another object is to warn users that the ink they are about to use may be a counterfeit product, or at least an ink that does not present the properties required by their printer.

Yet another object is to warn the user that the ink they are using, although compatible with their printer, has somehow altered and no longer presents the necessary properties. This aspect of the invention in particular targets printers that use recycled ink, such as continuous inkjet printers.

To achieve these goals, the invention relates more specifically to an ink quality control method, comprising:

an inkjet printer supplied with an integrated microbalance sensor for imprinted polymers, whereby the microbalance presents a setpoint vibratory characteristic when in contact with a setpoint ink containing at least one target compound compatible with the imprinted polymers, the microbalance being placed in contact with the ink feeding the printer, the measurement of a vibratory characteristic of the microbalance, a warning issued when this vibratory characteristic is different from the setpoint characteristic.

In the present description, imprinted polymer microbalance means a vibratory component onto which are grafted polymers carrying the molecular imprint of one or more target compounds. The polymers are known as molecular imprinted polymers (MIP). They present the property of being able to pair with molecules in the target compound. Molecular imprinted polymers are known.

When the imprinted polymer in the microbalance is placed in contact with a medium containing the target compound, the molecules in the target compound selectively pair with the polymer, thereby altering the mass of the microbalance. However, it should be underlined that although this pairing process is selective, it also depends on the concentration of target compound in the medium.

The main result of the change in mass of the microbalance is a change in its vibratory characteristics. In the present description, vibratory characteristic means a characteristic that reveals how the balance behaves in response to stimulation. The vibratory characteristic may be a resonance frequency, a Q factor, a rise time, or a relaxation time.

As stated above, the mass of the microbalance increases with increasing concentrations of the target molecule(s). This process is due to effect of pairing. Conversely, when the concentration decreases, the target molecules tend to release from the MIP via a mechanism that resembles desorption, thus inducing a decrease in mass. Increases in the mass of the microbalance will tend to induce a reduction in resonance frequency or rise time and an increase in relaxation time, while a decrease in the mass of the microbalance will have the opposite effects.

At a set target compound concentration in the medium, the microbalance tends to equilibrate with the medium and show a vibratory behavior that is characteristic for that concentration. The state of equilibrium depends not only on the microbalance but also on the target compound and its concentration. The state of equilibrium achieved when the microbalance is in contact with a medium containing the same target molecule concentration as for an ink termed a 'setpoint ink' shows the setpoint vibratory characteristics. The setpoint ink is an ink specially designed for use with a predetermined printer model or type of printer.

The setpoint characteristic can be preset during the manufacturing phase and when the microbalance is fitted with the imprinted polymers. It can also be measured and memorized as a setpoint characteristic by placing the microbalance in contact with a setpoint ink containing the target compound.

In principle, the choice of target compound(s) is not particularly important. The only constraint is that it has to be possible to produce imprinted polymers from the compound. That said, the risk remains that a particular target compound could easily be detected in an ink and reproduced by a counterfeit ink producer.

Therefore, in order to render the target compound undetectable, it is desirable to select a compound that is commonly found in ink. This would mean that compatibility with the microbalance would result solely from the concentration of the compound. Indeed, as stated above, the system according to the invention not only responds to the simple presence of a compound but, more importantly, to the presence of the compound at a given concentration, which is the setpoint concentration. Hence, the straightforward compositional analysis of an ink would not be able to determine which commonly-found component had been used as target compound.

Thus, the target compound is preferably a compound that also possesses biocidal or surfactant properties. Such compounds are commonly used in printer inks.

Aromatic surface-active compounds or biocides can be used, including isothiazolones, such as a Kathon, or other aromatic biocides, for example.

It is not necessary for the entire compound to be unprintable, as long as at least part of the compound is. The selected surfactants can be ionic or non-ionic, with an unprintable hydrophilic head, such as a sugar, or an aromatic compound, whether substituted or not, such as a benzyl, or an ammonium salt.

In an improved embodiment making it even more difficult to detect the target molecules, the imprinted polymers can be chosen to be selectively compatible with a range of target compounds, in particular two separate target compounds.

This can be easily achieved by simply grafting two or more types of imprinted polymers onto the microbalance, each compatible with their respective target compounds. In this scenario, the ink used needs follow a setpoint concentration for each of the target compounds. Indeed, the mass of the microbalance together with the fact that it presents a set vibratory characteristic will therefore depend not only on the simple presence of target molecules but also on the concentrations of these target molecules and their respective proportions in the ink.

The invention can be implemented in so-called 'drop-on-demand' printers, but can also be advantageously used in continuous inkjet printers. These printers work by deflecting a continuous jet of ink droplets, some of which are intended to reach the print substrate. The ink that is not used in the print is collected and re-used. However, the ink thus reused nevertheless undergoes tangible alterations as it is sprayed, alterations which tend to change its characteristics. These alterations are mainly caused by oxidation of the ink droplets as they are exposed to free air.

This oxidation may lead to changes in the ink color, but the main effect remains the destruction of the biocidal compounds contained in the ink. Once deprived of these biocides, the ink becomes vulnerable to bacterial proliferation, which generally leads to alterations in its fluidity.

To control the quality of the ink recycled, the process according to the invention preferably uses a microbalance where all or part of its imprinted polymers are compatible with at least one oxidizable part of one or more target compounds.

Thus, as the ink is exposed to free air, the oxidizable target compounds, or at least their oxidizable components, are subjected to oxidation. This has the effect of cancelling out the compatibility of these target compounds for the imprinted polymers and preventing molecular recognition of them.

The result is a change in the mass of the microbalance, which decreases, thereby triggering a shift in its vibratory characteristics.

In this scenario, the warning issued could be a prompt to refill or replace the printer ink. The oxidizable target compounds include, for example, the abovementioned isothiazolones or ammonium salts.

The invention also relates to an ink control system corresponding to the abovementioned process. The system includes an imprinted polymer microbalance, a comparator to compare the vibratory characteristic of the microbalance with a setpoint characteristic, and a warning device controlled by the comparator.

A divergence between the vibratory characteristic of the balance and the setpoint characteristic would trigger the warning device. The warning device may comprise an audible and (or) visual signal. This could, for example, be a message displayed on a screen, stating that the ink being used could compromise the print quality. This message could also indicate that the guarantee covering the printer would no longer apply if the user was to use the ink present in the reservoir for any significant amount of time.

Furthermore, in the event that a change is detected in the setpoint state of the microbalance, i.e. a change in its vibratory characteristics, this could, in addition to issuing a warning message, also be used to block certain printer functions.

For instance, if the comparator detects an abnormal vibratory characteristic, it could block the color printing function or cut the ink supply to the print head in order to preclude any damage.

Other characteristics and advantages of the invention will appear in the following description, with reference to the single FIGURE of the appended drawing that illustrates a particular implementation of the invention in an inkjet printer. This description is given purely as an illustration and is not an exhaustive example.

DETAILED DESCRIPTION OF THE INVENTION

The sole FIGURE gives a highly schematic illustration of a printer (1) with a microbalance (10) according to the invention. The microbalance comprises a piezoelectric vibrator (12) and a measurement module (14) intended to power the vibrator and produce a measurement signal representative of a vibrator characteristic. The vibrator (12) mainly comprises a crystal (16), such as a quartz crystal whose main faces carry electrodes (18) and (19). The electrodes are, for example, platinum or gold electrodes. The crystal can be subjected to either steady-state or other oscillation by applying the electric measurement signal to the electrodes. The oscillation of the crystal in turn produces an electrical output signal through the electrodes. The oscillation frequency, and more generally the oscillation characteristics mentioned previously, are affected by the mass of the vibrator, and in this case by the mass of one of the electrodes. The electric output signal is used to produce a measurement signal that takes into account the resonance frequency and a rise time or a relaxation time, for example.

In the example shown, one of the electrodes (18) is coated with a layer of imprinted polymers (20) grafted on to the electrode. The imprinted polymers are produced on target molecules used as imprint. This means they are compatible with these molecules and will tend to pair with this kind of molecule.

Imprinted polymers are manufactured in a known way that includes monomers being placed in contact with target molecules and the polymerization of said monomers around the target molecules. However, it is possible to skip a subsequent step whereby the target molecules are released once the imprinted polymers have been produced.

Indeed, when the layer of polymers (20) is placed in contact with an ink (22) that contains target molecules (24), a certain number of these target molecules will pair with imprinted polymers that have not already been paired. Conversely, if the ink does not contain target molecules, or contains them but only in low concentrations, the polymers already paired will tend to release their target molecules.

The contact between the layer of imprinted polymers and a setpoint ink (22) with a set concentration of target molecules will result in a state of equilibrium between the two target-molecule pairing and target-molecule release phenomena. Thus, this lends the polymer layer, and consequently the vibrator, a setpoint mass and setpoint vibratory characteristics.

In printer (1), the microbalance is in fluidic communication with the ink reservoir (30). The reservoir can, for example, be an ink cartridge. The microbalance may be fitted inside a conduit (32) linking reservoir (30) to an inkjet print head (34). An unused ink recovery conduit leading from print head (34) to a reservoir (36) is shown by a dashed line. The microbalance may also be fitted inside the ink recovery conduit in such as way as to be able to trigger ink overflow into a waste ink discharge reservoir (not represented in the FIGURE) when the ink falls below the setpoint characteristics.

The measurement signal coming from module (14) is routed to an input of comparator (40). The comparator compares this measurement signal to a setpoint signal to or to a predefined setpoint (42). This amounts to comparing the vibratory characteristics of the microbalance with the setpoint vibratory characteristics. The setpoint can be a predetermined value that matches a setpoint ink containing target molecules at a concentration that has also been predetermined. The set point can also be established and recorded when the microbalance achieves a state equilibrium in a setpoint ink and gives setpoint vibratory characteristics.

When the vibratory characteristics of the microbalance match the setpoint characteristics, within a predetermined error range, the comparator remains inactive. However, when the vibratory characteristics deviate from the setpoint characteristics outside of this error range, the comparator emits a signal that triggers a warning (44). This warning can, for example, be a screen display of a warning message. In a simpler embodiment, the warning may also be a straightforward signal light or a built-in buzzer.

Furthermore, the warning signal issued by the comparator could also trigger a refusal of the ink in use, or put all or part of the printer out of service. This embodiment is illustrated by the opening or closing of circuit interrupter (46).

One printer may comprise several microbalances. A separate microbalance can be associated with each ink channel in a color printer. Each color ink may comprise one or more target compounds that may be the same in each ink or different according to ink color. Thus, several different setpoint characteristics can be used for the same ink or for different inks with different colors.

The invention claimed is:

1. A process of controlling ink quality comprising:

providing an imprinted polymer microbalance in an inkjet printer, the imprinted polymer microbalance including a vibratory component with grafted polymers carrying the imprint of at least one target compound, whereby the microbalance presents an equilibrium setpoint vibratory characteristic when in contact with a setpoint ink containing the at least one target compound;

placing the microbalance in contact with a supply ink of the printer;

measuring a vibratory characteristic of the microbalance; and issuing a warning when the vibratory characteristic is different from the setpoint characteristic.

2. A process according to claim 1, further comprising:

allowing the microbalance to reach a state of equilibrium with a setpoint ink;

measuring a vibratory characteristic; and memorizing the vibratory characteristic as the setpoint characteristic.

3. A process according to claim 1, wherein the target compound is selected from among compounds including at least one of a biocidal property and a surfactant property.

4. A process according to claim 1, wherein the imprinted polymers are selectively compatible with a range of separately distinct target compounds.

5. A process according to claim 1, wherein the target compound is selected from at least one of an imprintable aromatic compound, an isothiazolone, and an ammonium salt.

6. A process according to claim 1, wherein the microbalance comprises imprintable polymers that are compatible with at least an oxidizable part of the target compound.

7. A process according to claim 1, further comprising:

blocking at least one printer function when the vibratory characteristic is different from the setpoint characteristic.

8. An ink control system comprising an imprinted polymer microbalance including a vibratory component with grafted polymers carrying the imprint of at least one target compound, a comparator to compare a vibratory characteristics of the microbalance with a setpoint characteristic, and a warning device controlled by the comparator.

9. An inkjet printer comprising:

an ink reservoir; and an ink control system that is in fluid communication with the ink reservoir, the ink control system including an imprinted polymer microbalance including a vibratory component with grafted polymers carrying the imprint of at least one target compound, a comparator to compare a vibratory characteristics of the microbalance with a setpoint characteristic, and a warning device controlled by the comparator.

10. A printer according to claim 9, wherein the microbalance is in a state of equilibrium with at least one target compound, the at least one target compound being selected from at least one of an imprintable aromatic compound, an isothiazolone, and an ammonium salt.

* * * * *